US009428853B2

(12) United States Patent
Kim et al.

(10) Patent No.: US 9,428,853 B2
(45) Date of Patent: Aug. 30, 2016

(54) WASHING MACHINE

(75) Inventors: Hyun Mook Kim, Osan-si (KR); Doo Pil Kim, Suwon-si (KR); Je Hong Min, Seongnam-si (KR); Kalo Jin Jun, Suwon-si (KR); Yong Jong Park, Seongnam-si (KR); Jae Ryong Park, Hwaseong-si (KR); Dong Pil Seo, Hwaseong-si (KR); Sang Hyeok Lee, Suwon-si (KR); In Cheol Jang, Hwaseong-si (KR); Sang Yeon Pyo, Suwon-si (KR); Jung Hee Lee, Suwon-si (KR); Ji Hoon Choi, Hwaseong-si (KR); Seung Oh Kim, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 1062 days.

(21) Appl. No.: 13/483,361

(22) Filed: May 30, 2012

(65) Prior Publication Data

US 2012/0304703 A1 Dec. 6, 2012

(30) Foreign Application Priority Data

May 30, 2011 (KR) ..... 10-2011-0051412
Feb. 6, 2012 (KR) ..... 10-2012-0011974

(51) Int. Cl.
*D06F 23/04* (2006.01)

(52) U.S. Cl.
CPC ..... *D06F 23/04* (2013.01)

(58) Field of Classification Search
CPC ..... D06F 23/04
See application file for complete search history.

(56) References Cited

U.S. PATENT DOCUMENTS

| | | | | |
|---|---|---|---|---|
| 2,869,344 | A | 1/1959 | Bochan | |
| 2,959,966 | A | 11/1960 | Bochan | |
| 3,091,107 | A | 5/1963 | Rhodes | |
| 3,306,082 | A * | 2/1967 | Hasegawa | D06F 17/06 192/12 BA |
| 5,271,251 | A | 12/1993 | Kovich et al. | |
| 2010/0175437 | A1 * | 7/2010 | Kim | D06F 7/206 68/23 R |

FOREIGN PATENT DOCUMENTS

| | | |
|---|---|---|
| JP | 2003-240050 | 8/2003 |
| KR | 1998-031623 | 7/1998 |
| KR | 10-2004-0058999 | 7/2004 |

OTHER PUBLICATIONS

Extended European Search Report issued Nov. 2, 2012 in corresponding European Patent Application No. 12169467.3.

* cited by examiner

*Primary Examiner* — Jason Ko
(74) *Attorney, Agent, or Firm* — Staas & Halsey LLP

(57) ABSTRACT

A washing machine having an improved structure which increases washing capacity without increasing the size of the washing machine. The washing machine includes a cabinet including an outer part and a cylindrical inner part connected to the outer part, a spin basket rotatably disposed in the inner part and including a bottom and a side wall extending from the bottom, a pulsator rotatably disposed in the spin basket, a motor provided under the spin basket, a clutch to selectively transmit power of the motor to the spin basket or the pulsator, a base plate to fix the clutch and the motor, and suspension members connecting the base plate to the upper portion of the cabinet. Wash water is stored within the spin basket and is not stored outside the spin basket during a washing cycle.

14 Claims, 11 Drawing Sheets

WASHING MACHINE

CROSS-REFERENCE TO RELATED APPLICATIONS

This application claims the benefit of Korean Patent Application Nos. 10-2011-0051412, filed on May 30, 2011, and 2012-0011974, field on Feb. 6, 2012, in the Korean Intellectual Property Office, the disclosures of which are incorporated herein by reference.

BACKGROUND

1. Field

Embodiments of the present disclosure relate to a washing machine.

2. Description of the Related Art

A washing machine is an apparatus which washes laundry using electricity, and generally includes a tub to store wash water, a spin basket rotatably installed in the tub, a pulsator rotatably installed at the bottom of the spin basket, and a motor and a clutch to rotate the spin basket and the pulsator.

When the spin basket and the pulsator are rotated under the condition that laundry and wash water are put into the spin basket, the pulsator agitates the laundry in the spin basket together with the wash water to remove dirt from the laundry.

In general, in order to increase washing capacity of the washing machine, a size of the spin basket into which the laundry is put, i.e., a diameter or height of the spin basket, may be increased, and in case that the size of the spin basket is increased, sizes of the tub accommodating the spin basket and a cabinet accommodating the tub may be increased also.

As the size of the cabinet, i.e., the size of the washing machine, is increased, a space in which the washing machine is installed is limited, and particularly, in the case of a vertical axis washing machine, as a height of the washing machine is increased, it is inconvenient to put laundry thereinto and thus a structure to solve such inconvenience may be required.

SUMMARY

Therefore, it is an aspect of the present disclosure to provide a washing machine having an improved structure which increases washing capacity without increase in the size of the washing machine.

Additional aspects of the disclosure will be set forth in part in the description which follows and, in part, will be apparent from the description, or may be learned by practice of the disclosure.

In accordance with one aspect of the present disclosure, a washing machine includes a cabinet including an outer part forming the external appearance of the washing machine, and a inner part connected to the inner surface of the outer part, a spin basket rotatably disposed in the inner part and including a bottom and a side wall extending from the bottom so as to be inclined such that the diameter of the side wall increases, a pulsator rotatably disposed in the spin basket, a motor provided under the spin basket, a clutch to selectively transmit power of the motor to the spin basket or the pulsator, a base plate to fix the clutch and the motor, and suspension members connecting the base plate to the upper portion of the cabinet to absorb vibration generated by the spin basket, where wash water is stored within the spin basket and is not stored outside the spin basket during a washing cycle.

The inner part may contact the inner surface of at least a portion of the outer part.

The outer part and the inner part may be integrally formed.

The side wall may include at least one through hole formed at the upper portion thereof so as to discharge the wash water to the outside of the spin basket during rotation of the spin basket.

The inner part may include a drain groove bending inwards from the lower end of the inner part along the circumference of the inner part to collect wash water dropped through the at least one through hole, and at least one first drain hole formed at one side of the drain groove to guide the wash water collected in the drain groove to the outside of the drain groove.

The spin basket may include a guide rib extending from the lower portion of the side wall to a designated length to guide the wash water discharged through the at least one through hole to the drain groove.

The drain groove may include a first bending part bending from the lower end of the inner part to the center of the inner part, and a second bending part bending from the end of the first bending part in a direction vertical to the ground, and the guide rib may be located between the second bending part and the inner circumferential surface of the inner part.

The clutch may include a housing and a drive shaft rotatably supported by bearings connected to the inside of the housing, and a flange member connecting the drive shaft and the spin basket to transmit rotary force of the drive shaft to the spin basket may be connected to the lower portion of the housing.

The flange member may include a first through hole formed through the center of the flange member so as to be connected to the drive shaft, and at least one second through hole formed around the first through hole to guide the wash water stored in the spin basket to the outside of the spin basket.

The inner part may be provided with a division plane extending from the end of the drain groove to the center of the inner part, and the spin basket and the base plate may be respectively disposed above and below the division plane.

The division plane may be configured such that the center thereof is higher than the edge thereof so as to allow wash water, flowing down along the side wall of the spin basket or from the bottom of the spin basket, to flow into the drain groove by gravity.

The washing machine may further include at least one connection bracket connecting the base plate and the suspension members, and the at least one connection bracket may be provided with an evasion groove to prevent interference with the drain groove during operation of the washing machine.

In accordance with another aspect of the present disclosure, a washing machine includes a cabinet including an outer part forming the external appearance of the washing machine, and a inner part connected to the inner surface of the outer part, and a spin basket rotatably disposed in the inner part and configured such that the diameter of the spin basket increases in the upward direction.

The spin basket may include a bottom and a side wall extending from the bottom so as to be inclined such that the diameter of the side wall increases.

The side wall may include at least one through hole formed along the circumference of the upper portion thereof as to discharge wash water to the outside of the spin basket during rotation of the spin basket.

The inner circumferential surface of the inner part, together with the outer circumferential surface of the side wall, may form a discharge channel along which the wash water discharged through the at least one through hole flows.

The inner part may include a drain groove bending inwards from the end of the inner part to collect wash water dropped along the discharge channel, and at least one first drain hole communicated with the drain groove to guide the wash water collected in the drain groove to the outside of the drain groove.

The spin basket may include a guide rib extending from the lower portion of the side wall to a designated length to guide the wash water discharged through the at least one through hole to the drain groove.

An interference prevention groove to prevent interference between the spin basket and the inner part may be formed between the bottom and the guide rib.

The inner part may include a bottom plane configured such that the center thereof is higher than the edge thereof so as to allow wash water, flowing down along the side wall of the spin basket or from the bottom of the spin basket, to flow to the drain groove The outer part and the inner part may be integrally formed by injection molding.

The washing machine may further include a motor located under the spin basket to provide power to rotate the spin basket, a clutch connected to the motor to transmit the power of the motor to the spin basket, a base plate to fix the clutch and the motor, and suspension members connecting the base plate to the upper portion of the cabinet to absorb vibration generated by the spin basket.

The washing machine may further include at least one connection bracket connecting the base plate and the suspension members.

In accordance with a further aspect of the present disclosure, a washing machine includes a cabinet forming the external appearance of the washing machine, a spin basket rotatably disposed in the cabinet and including a bottom and a side wall extending from the bottom so as to be inclined and provided with through holes formed only at a position of the side wall higher than ½ of the height of the side wall, a discharge channel formed by the outer circumferential surface of the side wall and the inner circumferential surface of the cabinet, a pulsator rotatably disposed in the spin basket, a motor provided under the spin basket, a clutch to selectively transmit power of the motor to the spin basket or the pulsator, a base plate fixing the clutch and the motor and connected to the upper portion of the cabinet, and a drain groove formed at the lower end of the cabinet to guide water, introduced through the through holes and the discharge channel during rotation of the spin basket, to the outside of the cabinet.

The washing machine may further include suspension members connecting the base plate to the upper portion of the cabinet to absorb vibration generated by the spin basket.

The washing machine may further include a flange member connected to the center of the bottom and provided with a through hole to discharge water stored in the spin basket to the outside of the spin basket.

The washing machine may further include a base plate cover connected to the upper portion of the base plate to guide water introduced through the drain groove to a region below the base plate.

The drain groove may include a first bending part bending from the lower end of the inner part to the center of the inner part, and a second bending part bending from the end of the first bending part in a direction vertical to the ground.

The washing machine may further include at least one first drain hole formed on the drain groove to guide the wash water collected in the drain groove to the outside of the drain groove.

The cabinet may include a bottom plane extending from the end of the drain groove to the center of the spin basket, and the bottom plane may be configured such that the center thereof is higher than the edge thereof so that wash water, flowing down along the side wall of the spin basket or from the bottom of the spin basket, flows to the drain groove.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
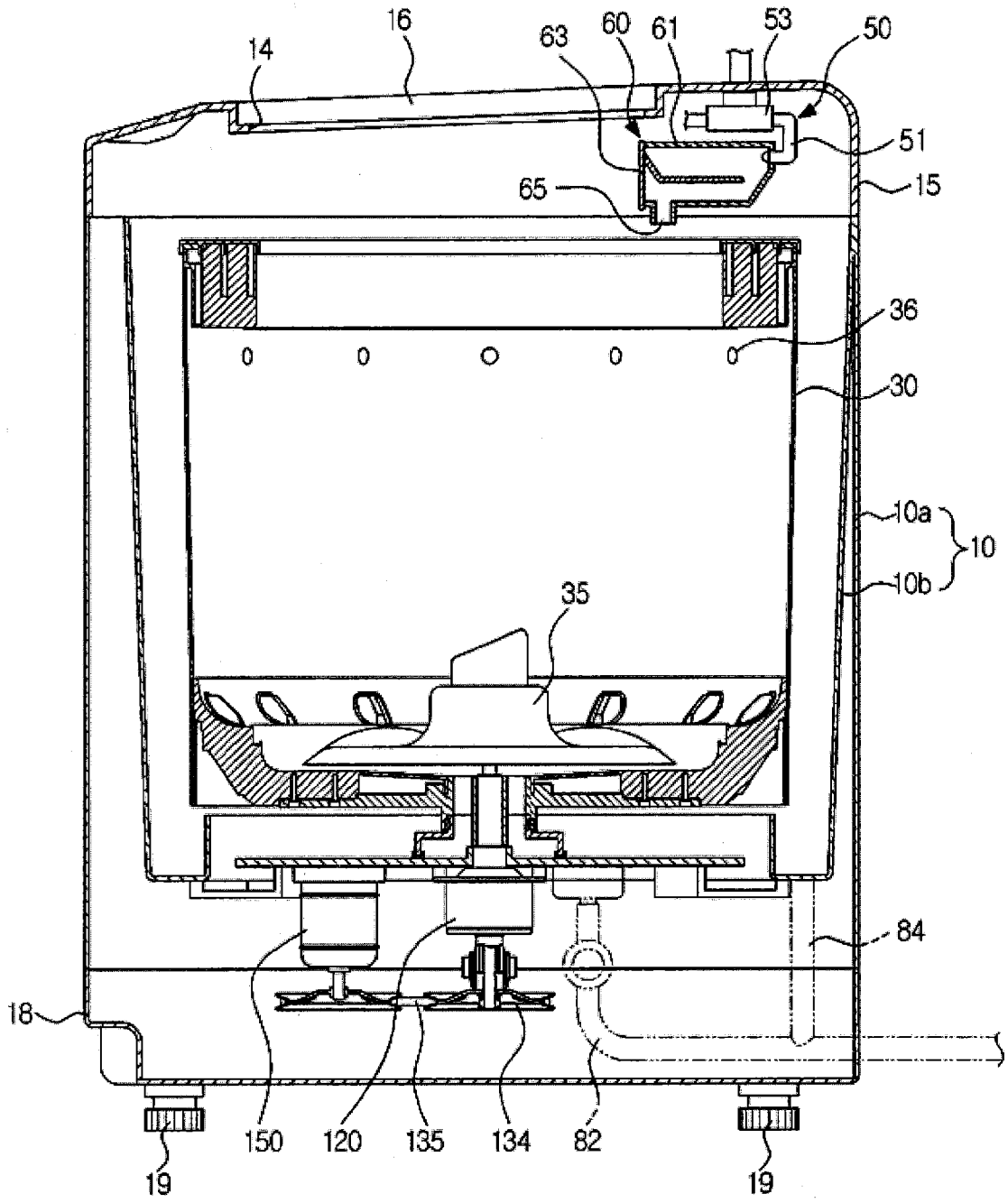
FIG. 1 is a cross-sectional view of a washing machine in accordance with one embodiment of the present disclosure.

Reference will now be made in detail to embodiments of the present disclosure, examples of which are illustrated in the accompanying drawings, wherein like reference numerals refer to like elements throughout.

FIG. 1 is a cross-sectional view of a washing machine in accordance with one embodiment of the present disclosure.

As shown in FIG. 1, a washing machine 1 includes a cabinet 10 forming the external appearance of the washing machine 1, a spin basket 30 rotatably disposed in the cabinet 10, and a drive unit disposed under the spin basket 30 to rotate the spin basket 30.

An upper cover 15 in which a laundry inlet 14 is formed to put laundry into the spin basket 30 therethrough is provided at the upper portion of the cabinet 10, and a door 16 to open and close the laundry inlet 14 is provided on the upper cover 15.

A lower cover 18 to which seat units 19 are connected to seat the washing machine 1 on the ground is provided at the lower portion of the cabinet 10.

Suspension members 21 (with reference to FIG. 2) to suspend the spin basket 30 to the cabinet 10 are connected to the upper portion of the cabinet 10.

The spin basket 30 is rotatably disposed in the cabinet 10, and a plurality of through holes 36 formed along the circumferential surface of the spin basket 30 is provided at the upper portion of the spin basket 30.

The pulsator 35 is rotatably installed at the bottom of the spin basket 30. The pulsator 35 serves to agitate the laundry in the spin basket 30 together with wash water.

A water supply device 50 to supply wash water to the inside of the spin basket 30 is installed above the spin basket 30. The water supply device 50 includes a water supply valve 53 to control supply of the wash water and a water supply pipe 51 connecting the water supply valve 53 to a detergent supply device 60.

One end of the water supply pipe 51 is connected to an external water supply source (not shown) and the other end of the water supply pipe 51 is connected to the detergent supply device 60.

The detergent supply device 60 includes a case 61 provided within the upper cover 15 and a detergent container 63 detachably mounted in the case 61 to accommodate respective detergents. A discharge hole 65 to discharge wash water in which detergents are dissolved is formed on the lower surface of the case 61.

Water supplied through the water supply pipe 51 is supplied to the inside of the spin basket 30 together with the detergents via the detergent supply device 60.

A first drain hose 82 and a second drain hose 84 to guide wash water to the outside of the cabinet 10 after a washing or a spin-drying cycle has been completed are provided under the spin basket 30.

The drive unit includes a clutch 120 to selectively rotate the spin basket 30 and the pulsator 35, a drive motor 150 to drive the clutch 120, a flange member 140 connecting a drive shaft 124 of the clutch 120 and a bottom 32 of the spin basket 30 to transmit rotary force of the drive shaft 124 to the spin basket 30, and a base plate 160 to fix the clutch 120 and the drive motor 150.

Hereinafter, a structure to increase washing capacity of the washing machine 1 without increase in the size of the washing machine 1 will be described in detail.

Figure 2:
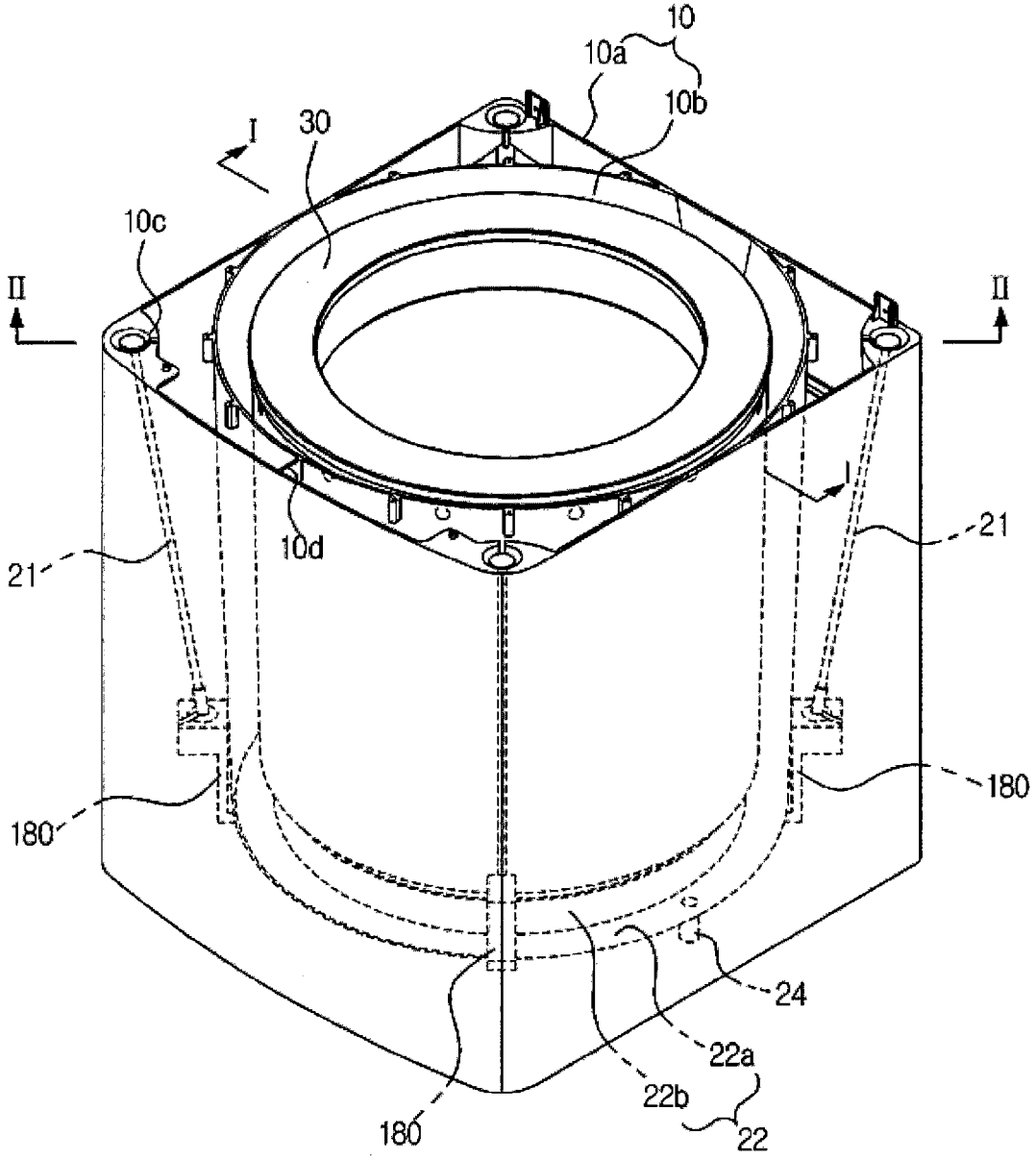
FIG. 2 is a perspective view of the washing machine in accordance with the embodiment of the present disclosure.
Figure 3:
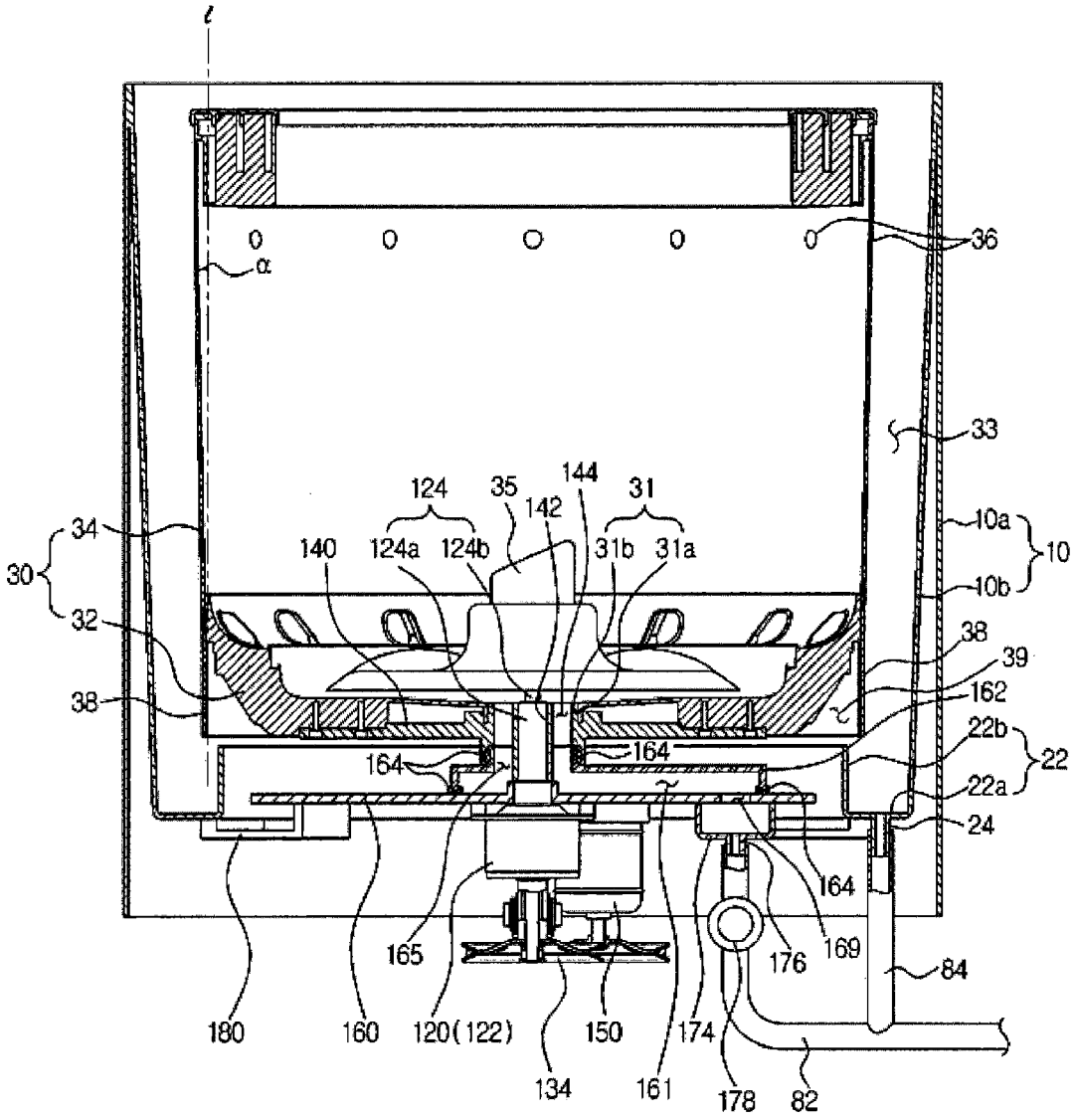
FIG. 3 is a cross-sectional view taken along the line I-I of FIG. 2.
Figure 4:
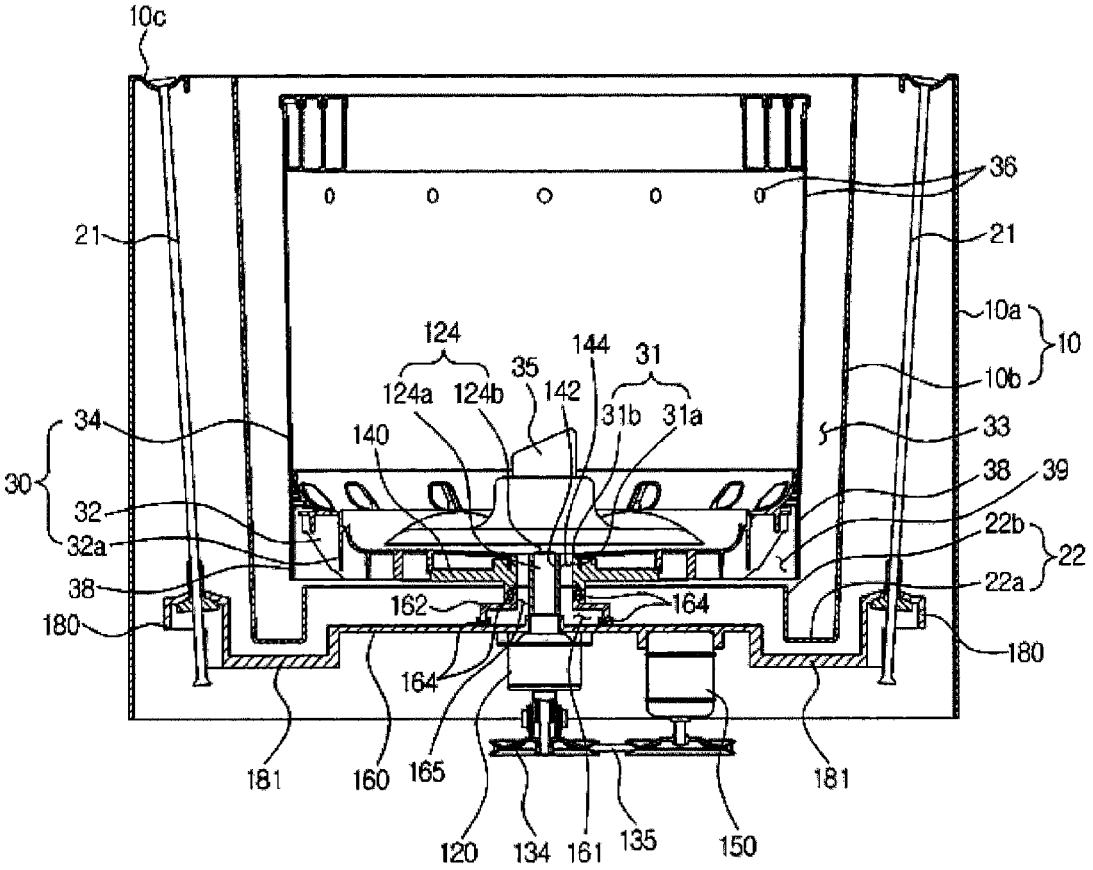
FIG. 4 is a cross-sectional view taken along the line II-II of FIG. 2.

FIG. 2 is a perspective view of the washing machine in accordance with the embodiment of the present disclosure, FIG. 3 is a cross-sectional view taken along the line I-I of FIG. 2, and FIG. 4 is a cross-sectional view taken along the line II-II of FIG. 2. FIGS. 2 to 4 illustrate a structure in which the upper cover 15 and the lower cover 18 are omitted.

As shown in FIGS. 2 to 4, the spin basket 30 is disposed in the cabinet 10 such that the spin basket 30 is separated from the cabinet 10 by a designated interval. That is, a separate configuration to store wash water between the cabinet 10 and the spin basket 30 is omitted.

The cabinet 10 includes an outer part 10*a* forming the external appearance of the washing machine 1, and an inner part 10*b* connected to the inner surface of the outer part 10*a*.

The inner part 10*b* has an approximately cylindrical shape, and the outer circumferential surface of the inner part 10*b* may be connected to the inner surface of at least a portion of the outer part 10*a* through connection ribs 10*d* or contact the inner surface of at least a portion of the outer part 10*a*. The inner part 10*b* is not limited to the cylindrical shape, but may have polygonal shapes, such as a rectangular shape or an octagonal shape.

The connection ribs 10*d*, if a portion of the outer part 10*a* is rounded for aesthetic appearance of the washing machine 1, connect the inner part 10*b* and the outer part 10*a* at the rounded portion of the outer part 10*a* and reinforce overall rigidity of the cabinet 10. Of course, the connection ribs 10*d* are not essential, and may thus be omitted according to design specifications.

The inner part 10*b* is inclined in a direction in which the radius of the inner part 10*b* increases from the lower portion thereof. Most of the water discharged to the outside of the spin basket 30 through the through holes 36 during the spin-drying cycle flows down along the inner circumferential surface of the inner part 10*b* and flows into a drain groove 22. Here, since the inner part 10*b* is inclined, the water discharged to the outside of the spin basket 30 slowly flows along the inclined surface of the inner part 10*b* and thus is not splashed to the outside of the drain groove 22 during a process of flowing of the water into the drain groove 22.

Further, the inner part 10*b* may have the same inclination angle as an inclination angle $\alpha$ of a side wall 34 of the spin basket 30 so as to be disposed in parallel with the side wall 34. During rotation of the spin basket 30, the spin basket 30 moves in the radial direction thereof as well as in the vertical direction. Therefore, a gap to prevent interference of the spin basket 30 with the inner part 10*b* of the cabinet 10 due to movement of the spin basket 30 in the radial direction thereof may be required, and space utilization within the cabinet is maximized and the gap is regularly maintained by allowing the inner part 10*b* and the side wall 34 to be disposed in parallel with each other.

In order to improve productivity, the outer part 10*a* and the inner part 10*b* may be integrally formed through injection molding. In this case, the cabinet 10 including the outer part 10*a* and the inner part 10*b* may be formed of a material, such as acrylonitrile butadiene styrene (ABS) or poly propylene (PP). One of the reasons why the cabinet 10 may be manufactured through injection molding is that the cabinet 10 includes the outer part 10*a* and the inner part 10*b* and thus the cabinet 10 is reinforced. That is, when a molding material, such as ABS or PP, is injected into a mold to manufacture the cabinet 10, solidified and then separated from the mold, damage to the cabinet 10 is prevented.

The outer part 10*a* and the inner part 10*b* may be formed of different materials and then be connected. That is, in order to reinforce the cabinet 10, the outer part 10*a* is formed of metal and the inner part 10*b* is formed of plastic and then the outer part 10*a* and the inner part 10*b* are connected to form the cabinet 10.

The drain groove 22 bending along the circumference of the inner part 10*b* is provided at the lower end of the inner part 10*b*.

The drain groove 22 includes a first bending part 22*a* bending from the lower end of the inner part 10*b* to the center of the inner part 10*b*, and a second bending part 22*b* bending from the end of the first bending part 22*a* in a direction vertical to the ground.

The first bending part 22*a* serves as a bottom plane to collect water, which is discharged to the outside of the spin basket 30 through the through holes 36 formed at the upper portion of the spin basket 30 and is dropped during the spin-drying cycle, or water, which flows along the outer circumferential surface of the spin basket 30 or the inner circumferential surface of the inner part 10*b*, and the second bending part 22*b* serves to form a channel to collect water, which is dropped to the bottom plane together with the inner circumferential surface of the lower end of the inner part 10*b*, and then to discharge the collected water to the outside.

A first drain hole 24 communicated with the drain groove 22 to guide the water collected in the drain groove 22 to the outside of the drain groove 22 is formed at one side of the first bending part 22*a*. The above-described second drain hose 84 is connected to one end of the first drain hole 24, and water having passed through the drain first hole 24 is finally discharged to the outside of the cabinet 10 through the second drain hose 84 and the first drain hose 82 connected to the second drain hose 84.

The spin basket 30 which is rotatable in the vertical direction is provided within the inner part 10*b*.

The spin basket 30 includes the bottom 32 and the side wall 34 connected to the bottom 32 to form a space to store wash water.

A plurality of ribs 32*a* is formed at the bottom 32. The ribs 32*a* form an air current in the radial direction of the spin basket 30, i.e., in a direction from the center of the spin basket 30 to the inner part 10*b* of the cabinet 10, during rotation of the spin basket 30, thereby preventing water flowing down along the outer circumferential direction of the spin basket 30 from moving to the central portion of the spin basket 30, in which the clutch 120 and the drive motor 150 are disposed, along the bottom 32 of the spin basket 30.

The side wall 34 extends from the bottom 32 so as to be inclined such that the diameter of the spin basket 30 increases. When the spin basket 30 is rotated at a high speed of about 280 rpm or more during the spin-drying cycle, water removed from laundry may reach the side wall 34 by centrifugal force and then be effectively moved to the upper portion of the spin basket 30 along the inner circumferential surface of the inclined side wall 34.

The inclination angle $\alpha$ formed by the side wall 34 relative to a straight line I vertical to the bottom 32 may be about 2° to 10°. If the inclination angle $\alpha$ is excessively small, i.e., below 2°, water is not effectively moved to the upper portion of the spin basket 30 along the inner circumferential surface of the side wall 34 and thus spin-drying capacity of the washing machine 1 may be lowered, and if the inclination angle $\alpha$ is excessively large, i.e., exceeds 10°, the upper portion of the spin basket 30 is widened and thus the overall width of the cabinet 10 may be increased.

The through holes 36 to discharge water removed from laundry during the spin-drying cycle to the outside of the spin basket 30 are formed at the upper portion of the side wall 34.

Here, at least one through hole 36 is formed at the side wall 34 in the circumferential direction, and a height of a portion of the spin basket 30 where the through holes 36 are formed may be more than ½ of the overall height of the spin basket 30. The reason why the height of the portion of the spin basket 30 where the through holes 36 are formed may be more than ½ of the overall height of the spin basket 30 is that leakage of wash water in the spin basket 30 through the through holes 36 during the washing cycle is prevented.

Water discharged to the outside of the spin basket 30 through the through holes 36 flows down along the outer circumferential surface of the spin basket 30 or the inner circumferential surface of the inner part 10*b* or flowing down through a discharge channel 33 formed between the side wall 34 and the inner circumferential surface of the inner part 10*b*, and then flows into the drain groove 22.

Further, a guide rib 38 to guide water, discharged to the outside of the spin basket 30 through the through holes 36, to the drain groove 22 may further provided.

The guide rib 38 is located between the second bending part 22*b* forming the drain groove 22 and the inner circumferential surface of the inner part 10*b*, and extends from the lower end of the side wall 34 to a designated length to prevent water flowing down along the outer circumferential surface of the spin basket 30 from moving to the central portion of the spin basket 30, in which the clutch 120 and the drive motor 150 are disposed, along the bottom 32 of the spin basket 30 and to allow the water to naturally flow into the drain groove 22.

An interference prevention groove 39 is formed to a designated depth between the side surface of the bottom 32 and the guide rib 38, thereby preventing interference between the spin basket 30 and the second bending part 22*b* due to vertical vibration of the spin basket 30 during operation of the washing machine 1.

The depth of the interference prevention groove 39 and the length of the guide rib 38 extending from the lower end of the side wall 34 relate to the magnitude of vertical vibration of the spin basket 30 during the washing or spin-drying cycle. As the magnitude of vertical vibration of the spin basket 30 increases, the depth of the interference prevention groove 39 increases and the length of the extending guide rib 38 decreases.

By locating the guide rib 38 between the second bending part 22*b* and the inner circumferential surface of the inner part 10*b* and allowing the second bending part 22*b* to be accommodated within the interference prevention groove 39, as described above, the overall height of the cabinet 10 may be lowered. That is, by allowing the guide rib 38 to be accommodated within the drain groove 22 and the second bending part 22*b* to be accommodated within the interference prevention groove 39 during vibration of the spin basket 30 in consideration of the magnitude of vertical vibration of the spin basket 30, the height of the cabinet 10 may be lowered by a length of a region where the guide rib 38 and the second bending part 22*b* overlap with each other.

The drive unit to drive the spin basket 30 or the pulsator 35 disposed in the spin basket 30 is connected to the lower portion of the spin basket 30.

The drive unit includes the clutch 120 to selectively rotate the spin basket 30 and the pulsator 35, the drive motor 150 to drive the clutch 120, the flange member 140 connecting the drive shaft 124 of the clutch 120 and the bottom 32 of the spin basket 30 to transmit rotary force of the drive shaft 124 to the spin basket 30, and the base plate 160 to fix the clutch 120 and the drive motor 150.

A shaft connection unit 31 connected to the flange member 140 to fix and support the flange member 140 is formed at the center of the bottom 32 of the spin basket 30. The shaft connection unit 31 includes a shaft connection wall 31*a* protruding downwards from the bottom 32 towards the outside of the spin basket 30, and a shaft insertion hole 31*b* formed within the shaft connection wall 31*a* so as to insert one end of the flange member 140 into the spin basket 30 through the shaft insertion hole 31*b*.

The flange member 140 connecting the drive shaft 124 and the spin basket 30 is inserted into and fixed to the shaft insertion hole 31*b*.

The flange member 140 includes a first through hole 142 formed through the center of the flange member 140 so as to be connected to the drive shaft 124, and a second through hole 144 formed in the circumferential direction around the first through hole 142.

The second through hole 144 serves as a movement channel along which wash water stored in the spin basket 30 is moved to the outside of the spin basket 30 after the washing cycle has been completed.

The clutch 120 includes a housing 122 and the drive shaft 124 rotatably connected to the center of the housing 122.

Various bearings to support rotation of the drive shaft 124 and speed reducers to reduce the rotational speed of the drive shaft 124 are provided in the inner space of the housing 122.

The drive shaft 124 passes through the first through hole 142 of the flange member 142 and is connected to the spin basket 30 and the pulsator 35.

The drive shaft 124 includes a first connection part 124*a* connected to the first through hole 142, and a second connection part 124*b* extending from the first connection part 124*a* and connected to the pulsator 35. The first connection part 124*a* and the second connection part 124*b* are simultaneously rotated or separately rotated according to the washing or spin-drying cycle. The second connection part 124*b* is rotated to rotate the pulsator 25 connected to the second connection part 124*b* during the washing cycle, and the first connection part 124*a* and the second connection part 124*b* are simultaneously rotated to rotate both the spin basket 30 and the pulsator 35 during the spin-drying cycle. A pulley 134 is connected to the other end of the drive shaft 124 to transmit rotary force of the drive motor 150 to the clutch 120 through belt 135.

A base plate cover 162 is connected between the flange member 140 and the base plate 160. The base plate cover 162 includes a second drain hole 165 communicated with the second through hole 144, and thus forms, together with the base plate 160, a space along which wash water introduced through the second through hole 144 and the second drain hole 165 is moved to a drain case 174. Further, sealing members 164 are interposed between the flange member 140 and the base plate cover 162 and between the base plate cover 162 and the base plate 160, thereby preventing leakage of wash water.

A third drain hole 169 to discharge water having introduced into the space 161 formed by the base plate cover 162 and the base plate 160 is formed through one side of the base plate 160, and the drain case 174 is connected to the lower portion of the base plate 160 so as to communicate with the third drain hole 169. The drain case 174 accommodates wash water introduced through the space formed by the base plate cover 162 and the base plate 160 and the third drain hole 169. A drain pipe 176 to drain the wash water introduced into the drain case 174 is provided at one end of the drain case 174, and the first drain hose 82 is connected to the drain pipe 176 to guide the wash water to the outside of the cabinet 10. A valve 178 is provided on the drain pipe 176, thereby selectively draining the wash water in the drain case 174 during the washing cycle.

The second drain hole 165 and the third drain hole 169 are elements to drain wash water used in the washing process, and the first drain hole 24 is an element to drain wash water removed from laundry in the spin-drying process. The second drain hole 165 is concentric with the center of rotation of the spin basket 30, the third drain hole 169 is separated from the second drain hole 165 at the outside of the second drain hole 165 by a designated distance in the radial direction of the spin basket 30, and the first drain hole 24 is separated from the third drain hole 169 at the outside of the third drain hole 169 by a designated distance in the radial direction of the spin basket 30. The first drain hole 24, the second drain hole 165 and the third drain hole 169 need not to be aligned on the same line.

Wash water used during the washing or rinsing cycle is introduced into the space between the base plate cover 162 and the base plate 160 through the second through hole 144 formed on the flange member 140 and the second drain hole 165, and is then drained to the outside of the cabinet 10 through the third drain hole 169, the drain case 174 and the first drain hose 82. Further, wash water removed from laundry during the spin-drying cycle is discharged to the outside of the spin basket 30 through the through holes 36, flows down into the drain groove 22 along the outer circumferential surface of the spin basket 30 or the inner circumferential surface of the inner part 10*b*, and is drained to the outside of the cabinet 10 through the first drain hole 24 and the second drain hose 84 connected to the first drain hole 24.

The base plate 160 is connected to the upper portion of the cabinet 10 by the suspension members 21. Here, at least two suspension members 21 are connected to corners of the cabinet 10 formed by the rectangular outer part 10*a* and the cylindrical inner part 10*b*, thus supporting the spin basket 30. Coupling ribs 10*c* to support one end of each of the suspension members 21 are provided at the corners of the cabinet 10. The coupling ribs 10*c* may be integrally formed with the outer part 10*a* and the inner part 10*b* through injection molding.

Connection brackets 180 are connected between the base plate 160 and the suspension members 21, and each of the connection brackets 180 is provided with an evasion groove 181 bent downward to prevent interference with the drain groove 22 during operation of the washing machine 1. The base plate 160 and the connection brackets 180 may be integrally formed with each other.

Since the spin basket 30 has a structure in which the spin basket 30 is connected to the clutch 120 and the base plate 160 fixing the clutch 120 below the spin basket 30 and the base plate 160 is connected to the upper portion of the cabinet 10 through the suspension members 21, load applied to the spin basket 30 is transmitted to the suspension members 21 through the base plate 160 and the suspension members 21 damp vibration due to the load applied to the spin basket 30.

As described above, the cabinet 10 has a dual structure including the outer part 10*a* and the inner part 10*b*, and thus has sufficient strength to support load applied to the spin basket 30, the clutch 120 and the drive motor 150 connected by the suspension members 21.

Figure 5:
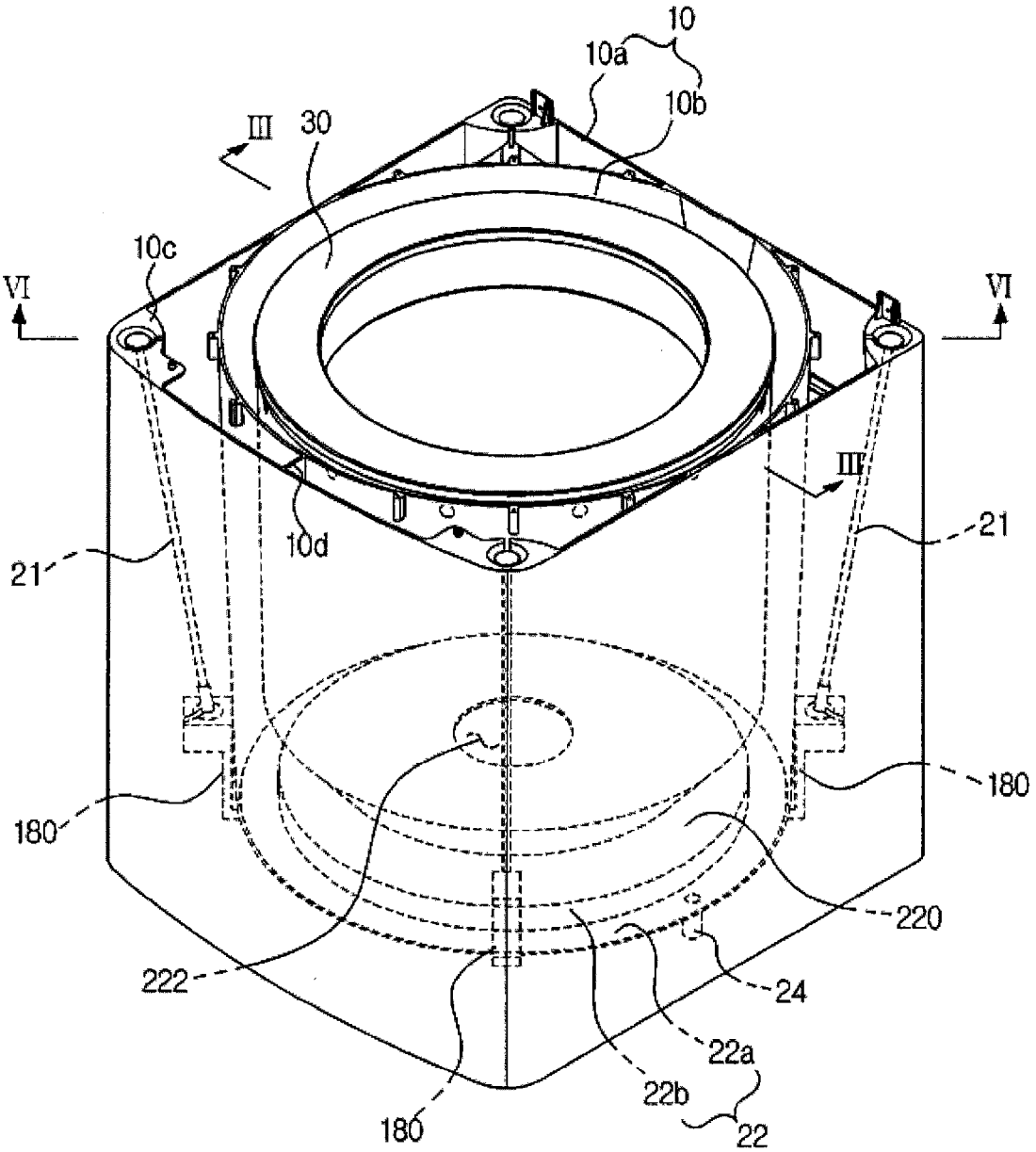
FIG. 5 is a perspective view of a washing machine in accordance with another embodiment of the present disclosure.
Figure 6:
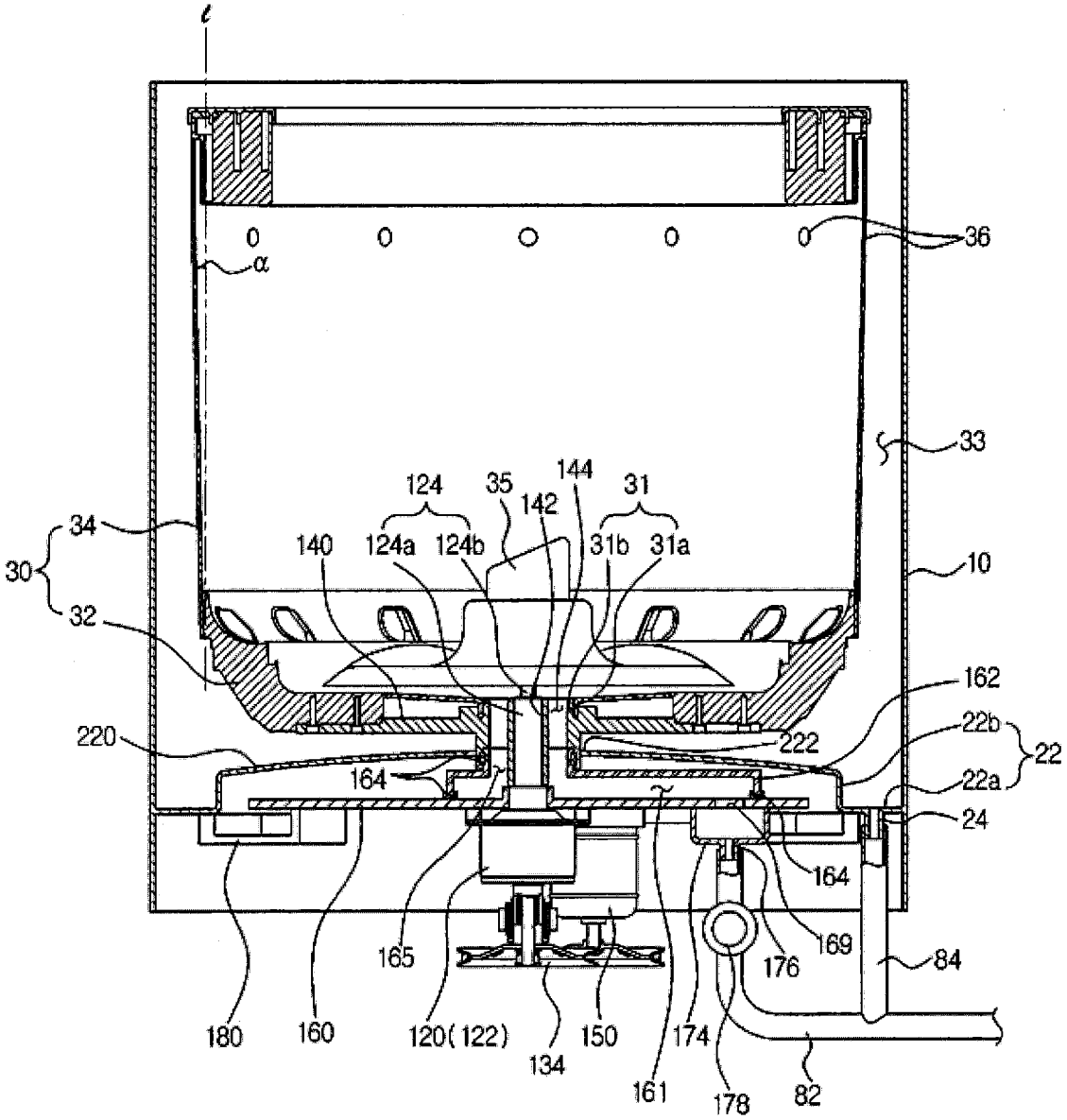
FIG. 6 is a cross-sectional view taken along the line III-III of FIG. 5.
Figure 7:
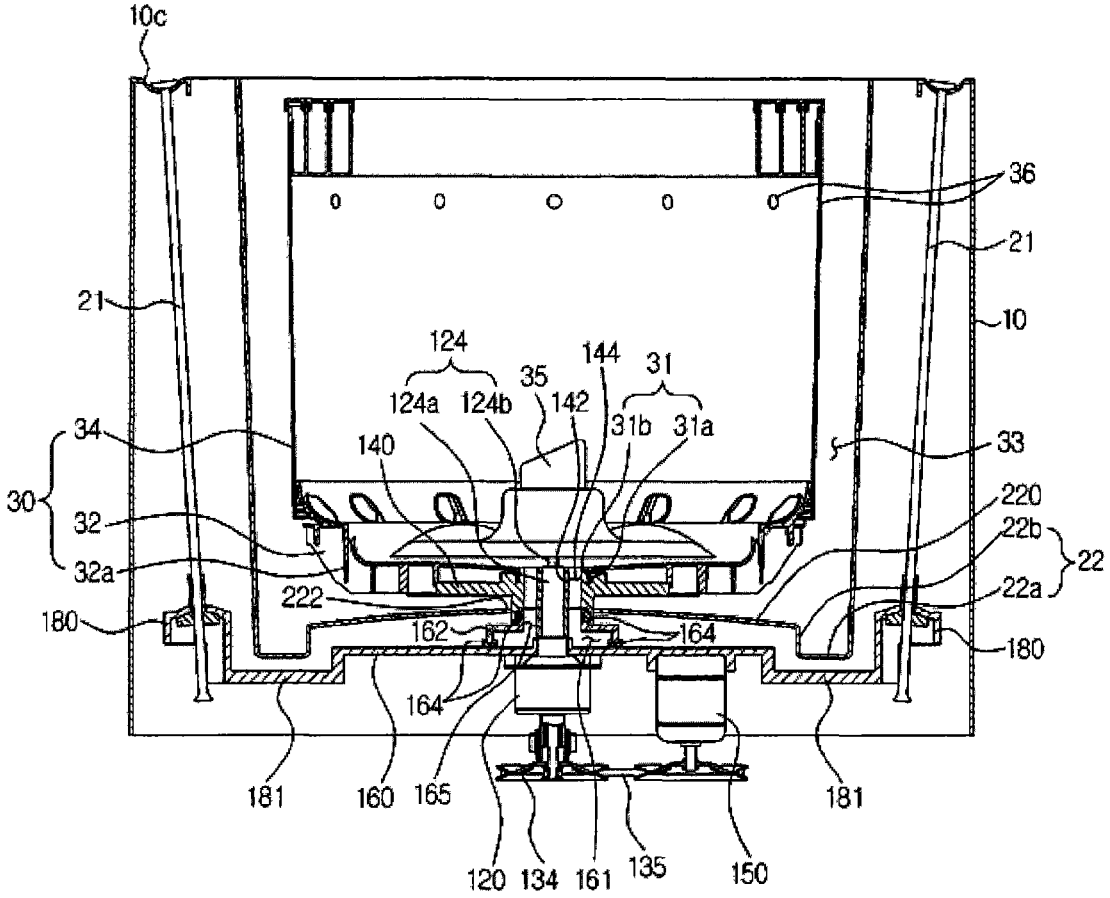
FIG. 7 is a cross-sectional view taken along the line IV-IV of FIG. 5.

FIG. 5 is a perspective view of a washing machine in accordance with another embodiment of the present disclosure, FIG. 6 is a cross-sectional view taken along the line III-III of FIG. 5, and FIG. 7 is a cross-sectional view taken along the line IV-IV of FIG. 5. FIGS. 5 to 7 illustrate a structure in which the upper cover 15, the lower cover 18.

Parts of the washing machine in accordance with this embodiment except for a bottom plane 220 are substantially the same as those of the washing machine in accordance with the former embodiment and thus are denoted by the same reference numerals even though they are depicted in different drawings, and a detailed description thereof will thus be omitted because it is considered to be unnecessary.

As shown in FIGS. 5 to 7, the cabinet 10 includes the bottom plane 220 extending from the end of the second bending part 22*b* of the drain groove 22 towards the center of the inner part 10*b*.

The bottom plane 220 is configured such that the center thereof is higher than the edge thereof, thereby guiding wash water, flowing down along the outer circumferential surface of the side wall 34 or from the bottom 32 of the spin basket 30, to the drain groove 22.

The bottom plane 220 vertically divides the upper spin basket 30 and the lower base plate 160 from each other, thus preventing wash water flowing down from the bottom 32 from being introduced into the center of the spin basket 30 in which clutch 120 and the drive motor 150 are omitted.

Further, a third through hole 222 is formed on the bottom plane 220, thus allowing the drive shaft 124 to be connected to the spin basket 30 and the pulsator 35 therethrough.

Figure 8:
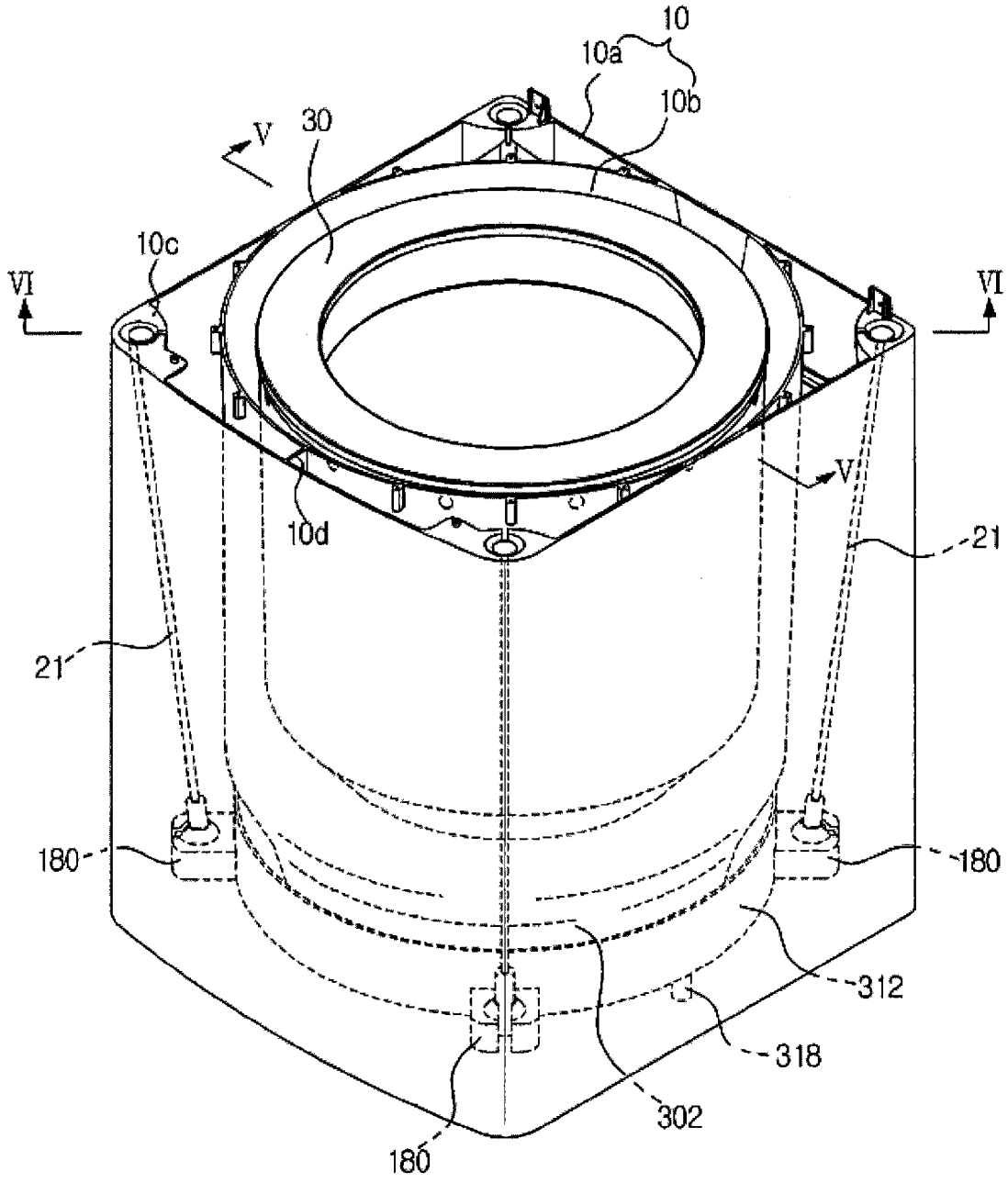
FIG. 8 is a perspective view of a washing machine in accordance with a further embodiment of the present disclosure.
Figure 9:
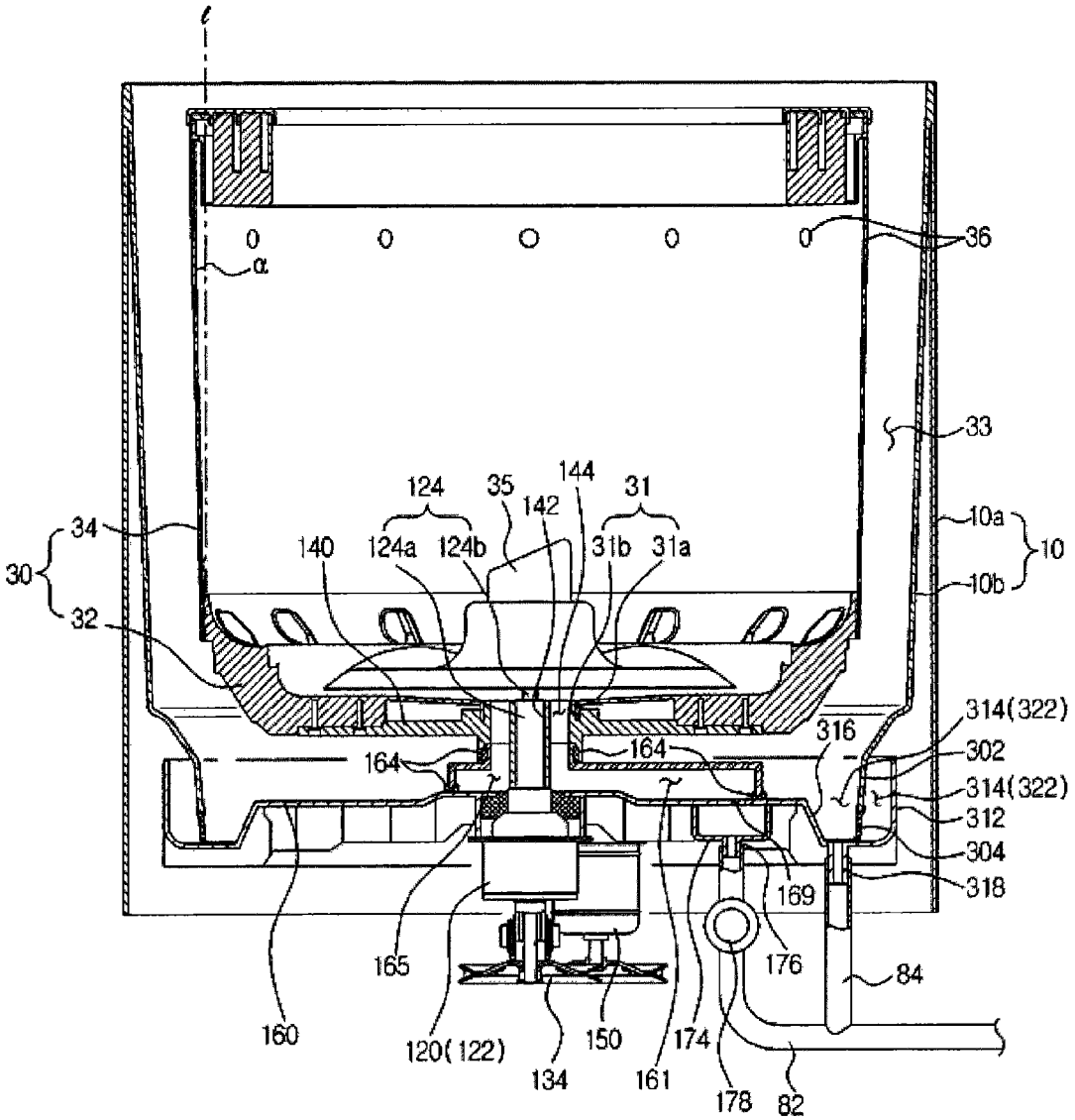
FIG. 9 is a cross-sectional view taken along the line V-V of FIG. 8.
Figure 10:
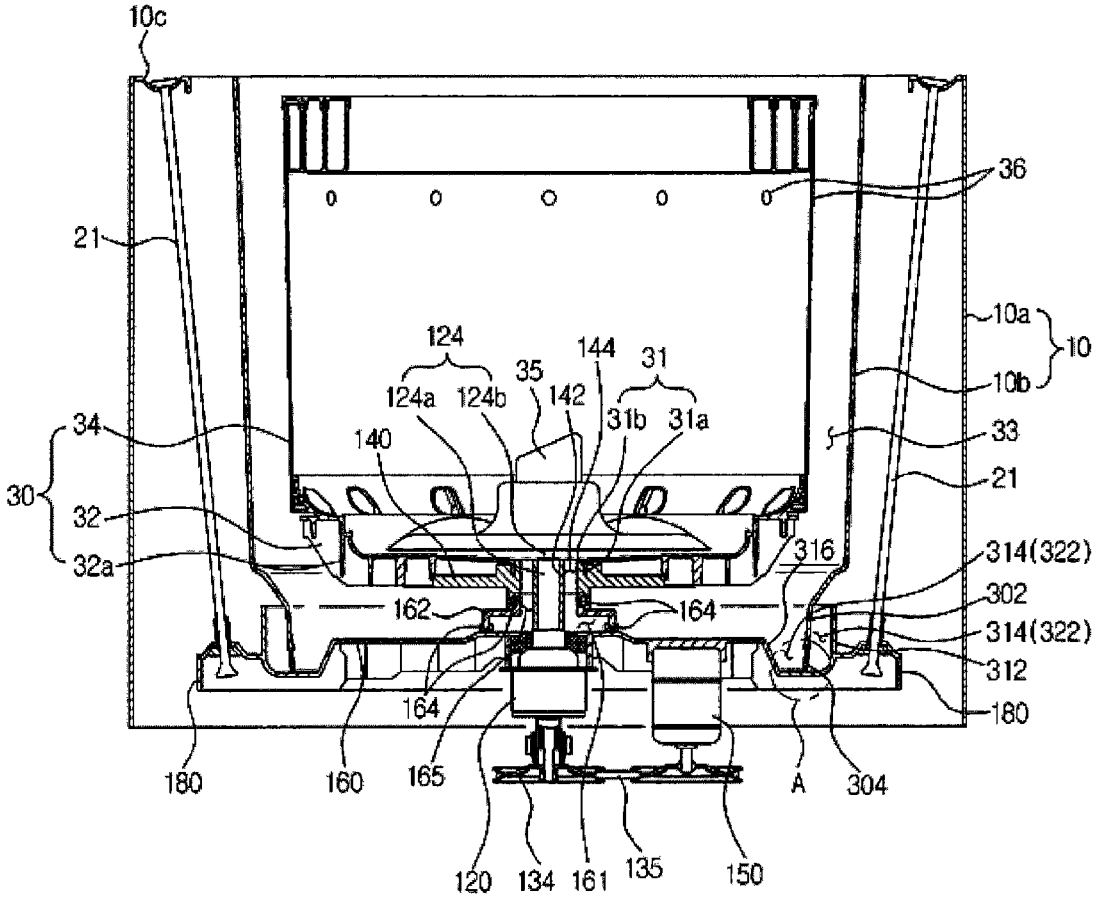
FIG. 10 is a cross-sectional view taken along the line VI-VI of FIG. 8.
Figure 11:
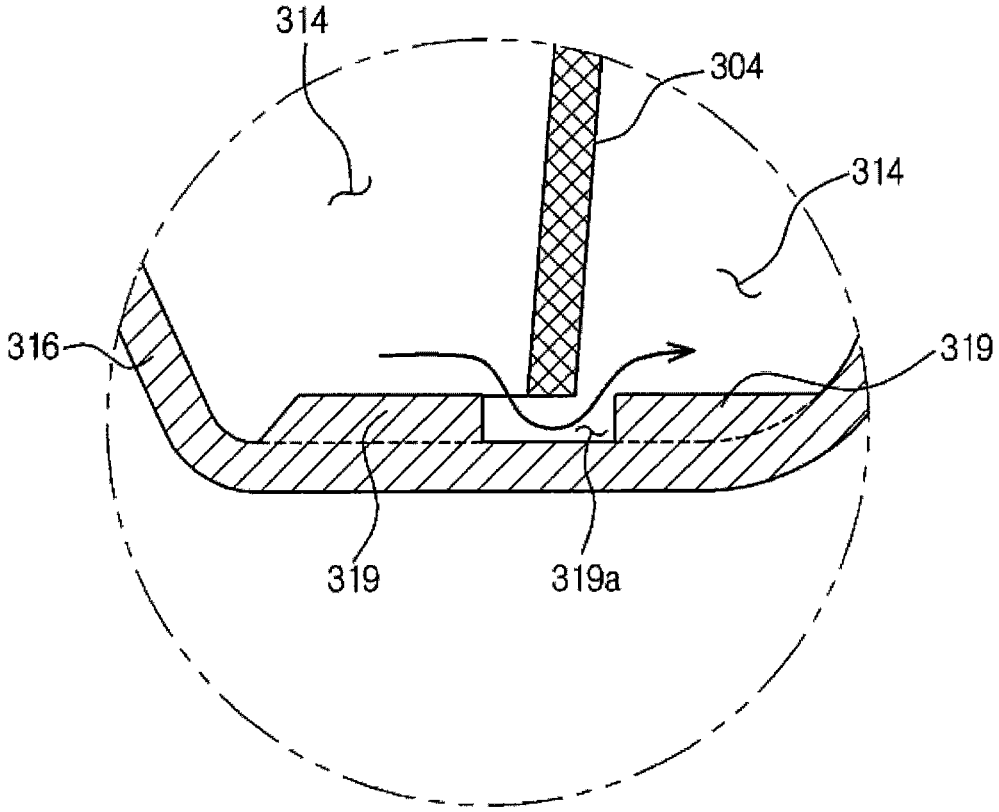
FIG. 11 is an enlarged view of the portion 'A' of FIG. 10.

FIG. 8 is a perspective view of a washing machine in accordance with a further embodiment of the present disclosure, FIG. 9 is a cross-sectional view taken along the line V-V of FIG. 8, FIG. 10 is a cross-sectional view taken along the line VI-VI of FIG. 8, and FIG. 11 is an enlarged view of the portion 'A' of FIG. 10. FIG. 8 illustrates a structure in which the upper cover 15, the lower cover 18 and the drive unit 100 are omitted.

Parts of the washing machine in accordance with this embodiment except for the lower structure of an inner part 10*b* and a base plate 160 relating to the lower structure of the inner part 10*b* are substantially the same as those of the washing machine in accordance with the former embodiment and thus are denoted by the same reference numerals even though they are depicted in different drawings, and a detailed description thereof will thus be omitted because it is considered to be unnecessary.

As shown in FIGS. 8 to 11, a guide part 302 to guide water flowing down along the inclined surface of the inner part 10*b* to the base plate 160 is provided at the lower portion of the inner part 10*b* of the cabinet 10, and a buffer member 304 to prevent collision between the inner part 10*b* and the base plate 160 is provided under the guide part 302.

The guide part 302 is extended from the lower end of the inner part 10*b* by a designated length and is configured such that at least one portion of the guide part 302 is accommodated within an accommodation rib 312 formed on the base plate 160, thereby allowing water, discharged through the through holes 36 and flowing down along the guide part 302 or the side wall 34 during the spin-drying process, to be dropped to the base plate 160.

The buffer member 304 is provided at the lower end of the guide part 302, and alleviates impact due to collision between the guide part 302 and the base plate 160 generated when the spin basket 30 vibrates in the upward and downward directions during the washing or spin-drying process and prevents damage to the guide part 302 and the base plate 160. The buffer member 304 may be formed of a soft material having elasticity and lower strength than materials of the guide part 302 and the base plate 160, such as rubber or plastic.

Further, the buffer member 304 prevents foreign substances from moving to the center of the spin basket 30 where the clutch 120, the drive motor 150, etc. are disposed through a gap between the guide part 302 and the base plate 160. Particularly, the buffer member 304 may prevent the washing machine 1 from malfunctioning due to interference of a small animal, such as a mouse, moving the center of the spin basket 30 through the gap between the guide part 302 and the base plate 160, with the clutch 120, the drive motor 150, etc.

The accommodation rib 312 to accommodate at least one portion of the guide part 302, an accommodation groove 314 to accommodate water flowing down along the guide part 302 or the side wall 34, and a stepped part 316 formed in a stepped shape at the inside of the guide part 302 to form the accommodation groove 134 together with the guide part 302 are formed around the edge of the base plate 160.

The accommodation rib 312 is extended from the upper surface of the edge of the base plate 160 by a designated length and forms the accommodation groove 314 together with the stepped part 316. The accommodation rib 312 accommodates at least one portion of the guide part 302 and prevents water flowing down along the guide part 302 or the side wall 34 or water accommodated within the accommodation groove 314 from leaking to the outer part 10*a*. That is, the guide part 302 and the accommodation rib 312 accommodating the guide part 302 at the outside of the guide part 302 prevent water, discharged to the outside of the spin basket 30 through the through holes 36 and flowing down along the guide part 302 or the side wall 34 during the spin-drying process, from leaking to the outer part 10*a*.

The accommodation groove 314 temporarily accommodates water flowing down along the guide part 302 or the side wall 34 during the spin-drying process. A drainage 318 communicating with the accommodation groove 314 to guide water accommodated within the accommodation groove 314 to the outside of the accommodation groove 314 is formed on the upper surface of the base plate 160 forming the accommodation groove 314. The above-described second drain hole 84 is connected to one end of the drainage 318, and water having passed through the drainage 318 is finally discharged to the outside of the cabinet 10 through the second drain hose 84 and the first drain hose 82 connected to the second drain hose 84.

As described above, water used during the washing or rinsing cycle is introduced into the space 161 between the base plate cover 162 and the base plate 160 through the second through hole 144 formed at the lower portion of the spin basket 30, and wash water removed from laundry during the spin-drying cycle is introduced into the accommodation groove 314 formed at the edge of the base plate cover 162 through the through holes 36 located at the upper portion of the spin basket 30. Therefore, the space 161 formed by the base plate cover 162 and the base plate 160 may be referred to as a first accommodation part, and the accommodation groove 314 may be referred to as a second accommodation part.

Further, as shown in FIG. 11, protrusions 319 to prevent a gap between the buffer member 304 and the upper surface of the base plate 160 from being clogged with foreign substances are formed on the upper surface of the base plate 160 adjacent to the buffer member 304. The protrusions 319 form a separate drain channel 319*a* along which water flows between the buffer member 304 and the base plate 160, thereby allowing water within the guide part 302 and the buffer member 304 to flow to a space among the guide part 302, the buffer member 304 and the accommodation rib 312 through the drain channel 319*a* even when the gap between the buffer member 304 and the upper surface of the base plate 160 is clogged.

As described above, a separate configuration to store wash water between the cabinet 10 and the spin basket 30 is omitted, and thus space utility within the cabinet 10 may be maximized. That is, the size of the spin basket 30 is increased without increase in the size of the cabinet 10, thus increasing washing capacity of the washing machine 1. Further, if the washing capacity of the washing machine 1 is not increased, the size of the cabinet 10 may be decreased without decrease in the size of the spin basket 30.

As is apparent from the above description, a washing machine in accordance with one embodiment of the present disclosure increases washing capacity without increase in the size of the washing machine, thus washing a large amount of laundry through one washing course.

Further, if the washing machine in accordance with the embodiment of the present disclosure has the same capacity as a general washing machine, the washing machine in accordance with the embodiment of the present disclosure has a smaller size than the general washing machine, and thus reduces a burden due to a limit in an installation space and allows laundry to be conveniently put into the washing machine, thereby improving user convenience.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A washing machine comprising:

a cabinet including an outer part forming the external appearance of the washing machine, and an inner part connected to the inner surface of the outer part, the outer part having a rectangular tubular shape and the inner part having an inverted truncated conical shape, a width or length of the outer part being approximately equal to a diameter of the top of the inner part;

a spin basket rotatably disposed in the inner part and including a bottom and a side wall extending from the bottom so as to be inclined such that the diameter of the side wall increases;

a pulsator rotatably disposed in the spin basket;

a motor provided under the spin basket;

a clutch to selectively transmit power of the motor to the spin basket or the pulsator;

a base plate to fix the clutch and the motor; and suspension members configured to directly connect the base plate to the upper portion of the cabinet to absorb vibration generated by the spin basket, wherein wash water is stored within the spin basket and is not stored outside the spin basket during a washing cycle.

2. The washing machine according to claim 1, wherein the inner part contacts the inner surface of at least a portion of the outer part.

3. The washing machine according to claim 2, wherein the outer part and the inner part are integrally formed.

4. The washing machine according to claim 1, wherein the side wall includes at least one through hole formed at the upper portion thereof so as to discharge the wash water to the outside of the spin basket during rotation of the spin basket.

5. The washing machine according to claim 4, wherein the inner part includes:

a drain groove bending inwards from the lower end of the inner part along the circumference of the inner part to collect wash water dropped through the at least one through hole; and at least one first drain hole formed at one side of the drain groove to guide the wash water collected in the drain groove to the outside of the drain groove.

6. The washing machine according to claim 5, wherein the spin basket includes a guide rib extending from the lower portion of the side wall to a designated length to guide the wash water discharged through the at least one through hole to the drain groove.

7. The washing machine according to claim 6, wherein:

the drain groove includes a first bending part bending from the lower end of the inner part to the center of the inner part, and a second bending part bending from the end of the first bending part in a direction vertical to the ground; and the guide rib is located between the second bending part and the inner circumferential surface of the inner part.

8. The washing machine according to claim 1, wherein:

the clutch includes a housing and a drive shaft rotatably supported by bearings connected to the inside of the housing; and a flange member connecting the drive shaft and the spin basket to transmit rotary force of the drive shaft to the spin basket is connected to the lower portion of the housing.

9. The washing machine according to claim 8, wherein the flange member includes:

a first through hole formed through the center of the flange member so as to be connected to the drive shaft; and at least one second through hole formed around the first through hole to guide the wash water stored in the spin basket to the outside of the spin basket.

10. The washing machine according to claim 5, wherein:

the inner part is provided with a division plane extending from the end of the drain groove to the center of the inner part; and the spin basket and the base plate are respectively disposed above and below the division plane.

11. The washing machine according to claim 10, wherein the division plane is configured such that the center thereof is higher than the edge thereof so that wash water, flowing down along the side wall of the spin basket or from the bottom of the spin basket, flows to the drain groove by gravity.

12. The washing machine according to claim 5, further comprising at least one connection bracket connecting the base plate and the suspension members, wherein the at least one connection bracket is provided with an evasion groove to prevent interference with the drain groove during operation of the washing machine.

13. The washing machine according to claim 4, wherein the base plate includes an accommodation groove to accommodate wash water discharged through the at least one through hole.

14. The washing machine according to claim 1, wherein at least one portion of the inner part is separated from at least one portion of the outer part.

* * * * *